US009897955B2

(12) United States Patent
Sato et al.

(10) Patent No.: US 9,897,955 B2
(45) Date of Patent: Feb. 20, 2018

(54) PRESSURE MEMBER, FIXING DEVICE, AND IMAGE FORMING APPARATUS

(71) Applicant: FUJI XEROX CO., LTD., Tokyo (JP)

(72) Inventors: Hideki Sato, Kanagawa (JP); Jun Sawamura, Kanagawa (JP); Yoshiro Konishi, Kanagawa (JP); Yasuhiro Kato, Kanagawa (JP); Takayuki Ukawa, Kanagawa (JP); Masahiro Akatsuka, Kanagawa (JP); Yusuke Sakurai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/233,118

(22) Filed: Aug. 10, 2016

(65) Prior Publication Data

US 2017/0255148 A1 Sep. 7, 2017

(30) Foreign Application Priority Data

Mar. 1, 2016 (JP) ..... 2016-039312

(51) Int. Cl.
*G03G 15/20* (2006.01)

(52) U.S. Cl.
CPC ..... *G03G 15/2085* (2013.01)

(58) Field of Classification Search
CPC ..... G03G 15/2085
USPC ..... 399/329
See application file for complete search history.

(56) References Cited

U.S. PATENT DOCUMENTS

2010/0296849 A1* 11/2010 Yamamoto ..... G03G 15/657 399/329
2012/0251206 A1 10/2012 Nakamura et al.
2015/0227096 A1* 8/2015 Nemoto ..... G03G 15/2053 399/329

FOREIGN PATENT DOCUMENTS

JP 2005227322 A * 8/2005
JP 2012-208308 A 10/2012

* cited by examiner

*Primary Examiner* — Susan Lee
(74) *Attorney, Agent, or Firm* — Sughrue Mion, PLLC

(57) ABSTRACT

A fixing device includes a rotatably-supported first fixing member and a second fixing member pressed against the first member. The second member includes a belt-shaped component, a support component, and a pressing component. The belt-shaped component extends in a width direction of a medium passing through a contact region between the belt-shaped component and the first member. The support component is disposed opposite the first member with the belt-shaped component interposed therebetween. The pressing component has a base end supported by the support component and a free end extending toward the contact region and presses the belt-shaped component against the first member. The pressing component has biasing portions arranged apart in the width direction and elastically deformable in correspondence with the medium thickness. The biasing portions are connected in the width direction by the free end. The free end is disposed at an upstream side in a medium transport direction.

6 Claims, 10 Drawing Sheets

PRESSURE MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2016-039312 filed Mar. 1, 2016.

BACKGROUND

Technical Field

The present invention relates to pressure members, fixing devices, and image forming apparatuses.

SUMMARY

According to an aspect of the invention, there is provided a fixing device including a first fixing member and a second fixing member. The first fixing member is supported in a rotatable manner. The second fixing member is pressed against the first fixing member and includes a belt-shaped component, a support component, and a pressing component. The belt-shaped component extends in a width direction of a medium that passes through a contact region where the belt-shaped component comes into contact with the first fixing member. The support component is disposed opposite the first fixing member with the belt-shaped component interposed therebetween. The pressing component has a base end portion supported by the support component and a free end portion extending toward the contact region and presses the belt-shaped component against the first fixing member. The pressing component has multiple biasing portions that are arranged apart in the width direction and that are elastically deformable in correspondence with a thickness of the medium. The biasing portions are connected in the width direction of the medium by the free end portion. The free end portion is disposed at an upstream side in a transport direction of the medium.

BRIEF DESCRIPTION OF THE DRAWINGS

An exemplary embodiment of the present invention will be described in detail based on the following figures, wherein.

DETAILED DESCRIPTION

Figure 1:
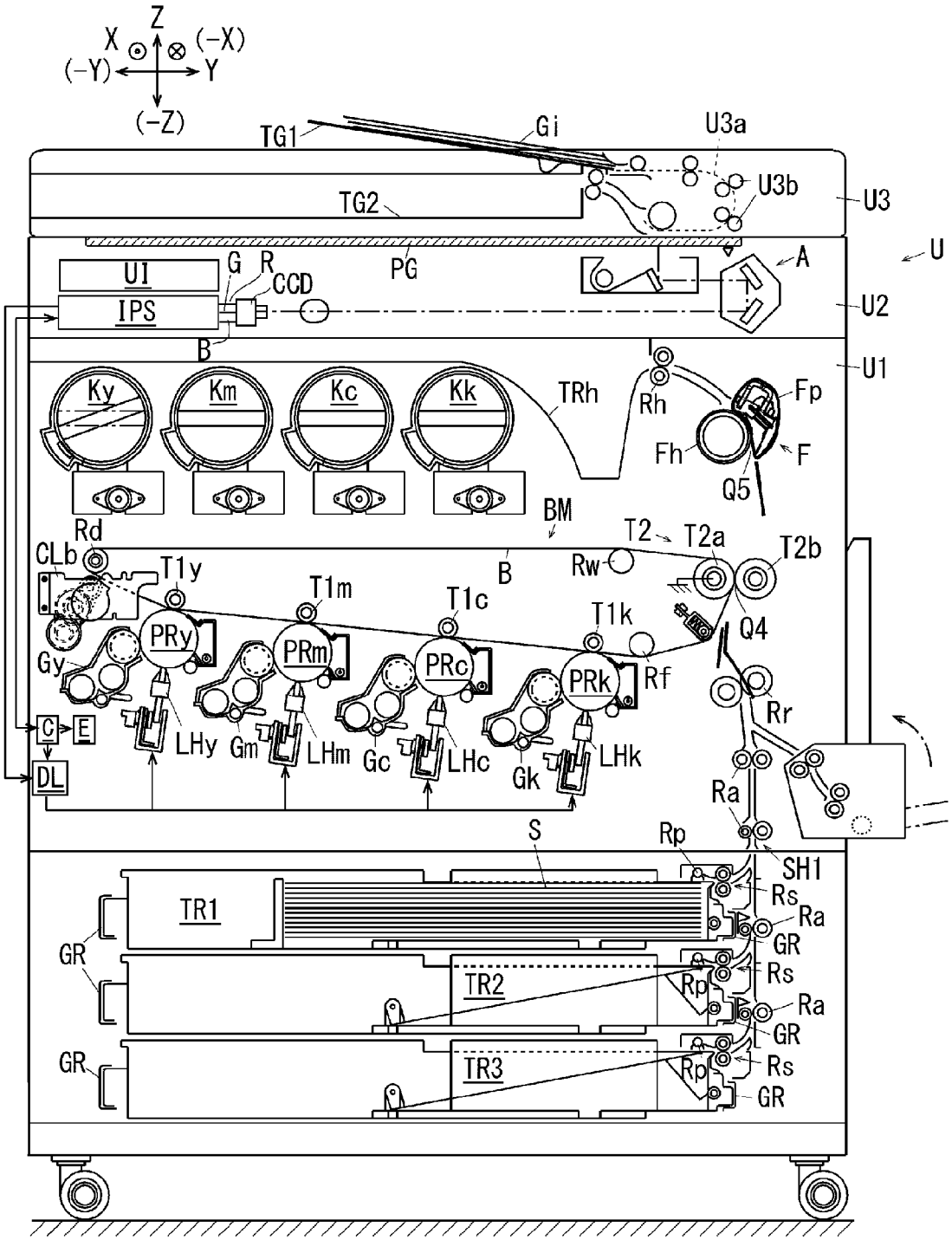
FIG. 1 illustrates an image forming apparatus according to a first exemplary embodiment.

Although a specific exemplary embodiment of the present invention will be described below with reference to the drawings, the present invention is not to be limited to the following exemplary embodiment.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 illustrates an image forming apparatus according to a first exemplary embodiment.

Figure 2:
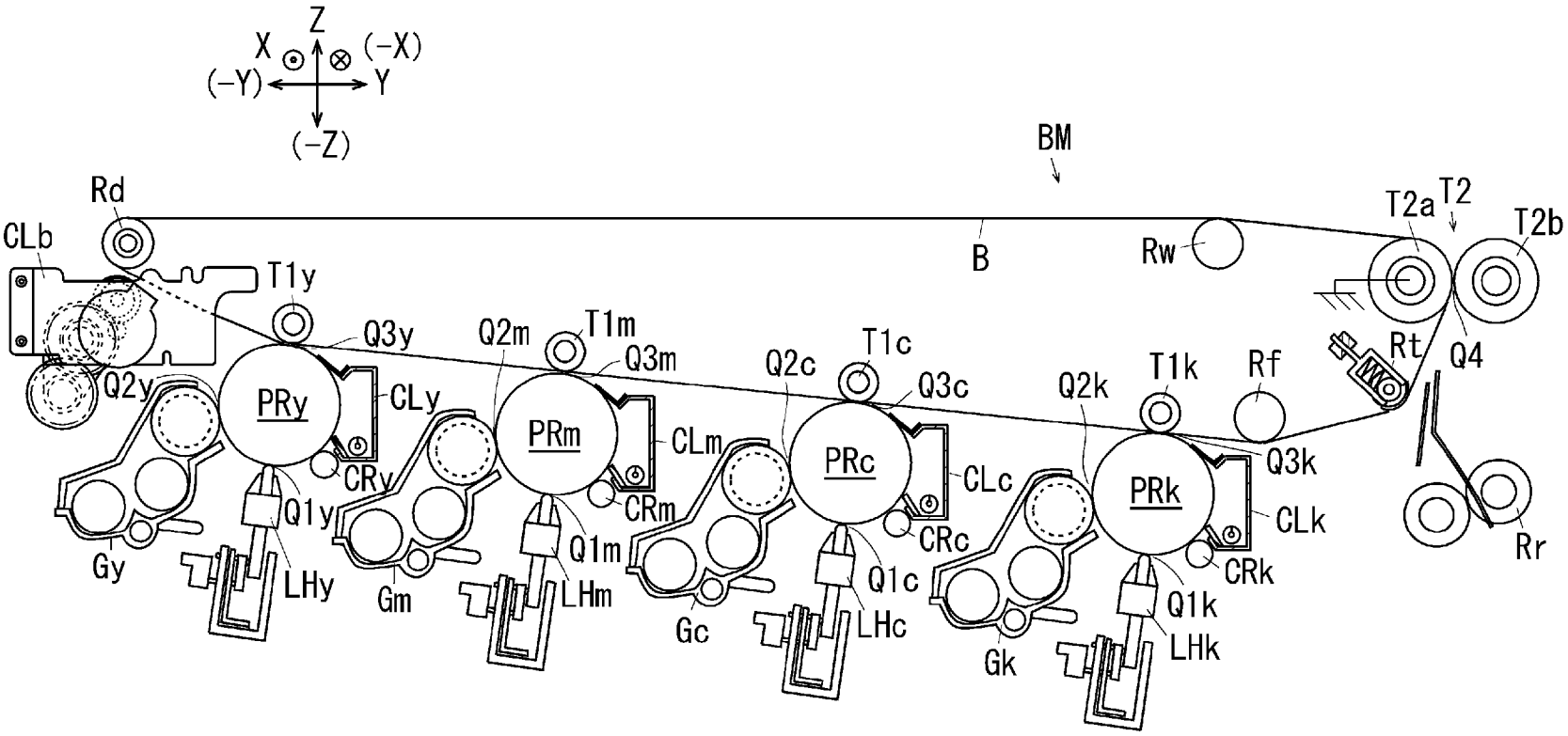
FIG. 2 illustrates a relevant part of the image forming apparatus according to the first exemplary embodiment.

FIG. 2 illustrates a relevant part of the image forming apparatus according to the first exemplary embodiment.

In FIG. 1, a copier U as an example of the image forming apparatus according to the first exemplary embodiment of the present invention is an example of an apparatus body and has a printer unit U1 as an example of an image recording device. A scanner unit U2 as an example of a reader unit as well as an example of an image reading device is supported at the upper portion of the printer unit U1. An auto feeder U3 as an example of a document transport device is supported at the upper portion of the scanner unit U2. The scanner unit U2 according to the first exemplary embodiment supports a user interface UI as an example of an input unit. An operator may input information to the user interface UI so as to operate the copier U.

A document tray TG1 as an example of a medium container is disposed at the upper portion of the auto feeder U3. The document tray TG1 is capable of accommodating a stack of multiple documents Gi to be copied. A document output tray TG2 as an example of a document output unit is provided below the document tray TG1. Document transport rollers U3*b* are arranged along a document transport path U3*a* between the document tray TG1 and the document output tray TG2.

Platen glass PG as an example of a transparent document table is disposed at the upper surface of the scanner unit U2. In the scanner unit U2 according to the first exemplary embodiment, a reading optical system A is disposed below the platen glass PG. The reading optical system A according to the first exemplary embodiment is supported in a movable manner in the left-right direction along the lower surface of the platen glass PG. Normally, the reading optical system A is in a stopped state at an initial position shown in FIG. 1.

An imaging element CCD as an example of an imaging member is disposed to the left of the reading optical system A. The imaging element CCD is electrically connected to an image processor IPS.

The image processor IPS is electrically connected to a write circuit DL of the printer unit U1. The write circuit DL is electrically connected to light-emitting-diode (LED) heads LHy, LHm, LHc, and LHk as an example of latent-image forming devices.

Photoconductor drums PRy, PRm, PRc, and PRk as an example of image carriers are respectively disposed above the LED heads LHy to LHk.

Charging rollers CRy, CRm, CRc, and CRk as an example of charging units are respectively disposed facing the photoconductor drums PRy to PRk. The charging rollers CRy to CRk receive charge voltage from a power supply circuit E. The power supply circuit E is controlled by a controller C as an example of a controller. The controller C performs various kinds of control by exchanging signals with, for example, the image processor IPS and the write circuit DL.

In write regions Q1*y*, Ql*m*, Q1*c*, and Q1*k* set downstream of the charging rollers CRy to CRk in the rotational direction of the photoconductor drums PRy to PRk, the LED heads LHy to LHk radiate write light onto the surfaces of the photoconductor drums PRy to PRk.

In developing regions Q2*y*, Q2*m*, Q2*c*, and Q2*y* set downstream of the write regions Q1*y* to Q1*k* in the rotational direction of the photoconductor drums PRy to PRk, developing devices Gy, Gm, Gc, and Gk are disposed facing the surfaces of the respective photoconductor drums PRy to PRk.

First-transfer regions Q3*y*, Q3*m*, Q3*c*, and Q3*k* are set downstream of the developing regions Q2*y* to Q2*y* in the rotational direction of the photoconductor drums PRy to PRk. In the first-transfer regions Q3*y* to Q3*k*, the photoconductor drums PRy to PRk are in contact with an intermediate transfer belt B as an example of an intermediate transfer member. Furthermore, in the first-transfer regions Q3*y*, Q3*m*, Q3*c*, and Q3*k*, first-transfer rollers T1*y*, T1*m*, T1*c*, and T1*k* as an example of first-transfer units are disposed opposite the photoconductor drums PRy to PRk with the intermediate transfer belt B interposed therebetween.

Drum cleaners CLy, CLm, CLc, and CLk as an example of image-carrier cleaning units are disposed downstream of the first-transfer regions Q3*y* to Q3*k* in the rotational direction of the photoconductor drums PRy to PRk.

In the first exemplary embodiment, the photoconductor drums PRy to PRk and the drum cleaners CLy to CLk are configured as photoconductor units as an example of image carrier units for the respective colors and are integrally detachable from the printer unit U1. Moreover, the developing devices Gy to Gk serving as developing units are also detachable from the printer unit U1.

A belt module BM as an example of an intermediate transfer device is disposed above the photoconductor drums PRy to PRk. The belt module BM has the aforementioned intermediate transfer belt B. The intermediate transfer belt B is supported in a rotatable manner by a driving roller Rd as an example of a driving member, a tension roller Rt as an example of a tension member, a working roller Rw as an example of a meander correction member, an idler roller Rf as an example of a driven member, a backup roller T2*a* as an example of a second-transfer-region opposing member, and first-transfer rollers T1*y*, T1*m*, T1*c*, and T1*k*.

A second-transfer roller T2*b* as an example of a second-transfer member is disposed opposite the backup roller T2*a* with the intermediate transfer belt B interposed therebetween. The backup roller T2*a* and the second-transfer roller T2*b* constitute a second-transfer unit T2. A second-transfer region Q4 is formed by a region where the second-transfer roller T2*b* and the intermediate transfer belt B face each other.

For example, the first-transfer rollers T1*y* to T1*k*, the intermediate transfer belt B, and the second-transfer unit T2 constitute a transfer device T1+T2+B according to the first exemplary embodiment that transfers images formed on the photoconductor drums PRy to PRk onto a medium.

A belt cleaner CLb as an example of an intermediate-transfer-member cleaning unit is disposed downstream of the second-transfer region Q4 in the rotational direction of the intermediate transfer belt B.

Cartridges Ky, Km, Kc, and Kk as an example of developer containers are disposed above the belt module BM. The cartridges Ky to Kk accommodate developers to be supplied to the developing devices Gy to Gk. The cartridges Ky to Kk and the developing devices Gy to Gk are respectively connected by developer supplying devices (not shown).

Feed trays TR1 to TR3 as an example of medium containers are disposed at the lower portion of the printer unit U1. The feed trays TR1 to TR3 are supported in a detachable manner in the front-rear direction by guide rails GR as an example of guide members. The feed trays TR1 to TR3 accommodate recording sheets S therein as an example of media.

A pickup roller Rp as an example of a medium pickup member is disposed at the upper right side of each of the feed trays TR1 to TR3. A separation roller Rs as an example of a separation member is disposed to the right of the pickup roller Rp.

A medium transport path SH1 extending upward is provided to the right of the feed trays TR1 to TR3. The transport path SH1 has multiple transport rollers Ra arranged therein as an example of medium transport members. In a downstream area of the transport path SH1 in the transport direction of the recording sheet S, a registration roller Rr as an example of a delivery member is disposed upstream of the second-transfer region Q4.

A fixing device F is disposed above the second-transfer region Q4. The fixing device F has a heating roller Fh as an example of a first fixing member as well as an example of a heating member, and also has a pressure member Fp as an example of a second fixing member. A contact region between the heating roller Fh and the pressure member Fp constitutes a fixing region Q5. The heating roller Fh has a built-in heater (not shown) as an example of a heat source.

An output roller Rh as an example of a medium transport member is disposed obliquely above the fixing device F. An output tray TRh as an example of a medium output unit is provided to the left of the output roller Rh.

Image Forming Operation

The multiple documents Gi accommodated in the document tray TG1 sequentially pass over a document read position on the platen glass PG and are output onto the document output tray TG2.

In a case where copying is to be performed by transporting the documents Gi automatically by using the auto feeder U3, the documents Gi sequentially passing over the read position on the platen glass PG are exposed to light with the reading optical system A maintained in the stopped state at the initial position.

In a case where copying is to be performed by allowing the operator to manually place a document Gi on the platen glass PG, the reading optical system A moves in the left-right direction so that the document Gi on the platen glass PG is scanned while being exposed to light.

The reflected light from the document Gi travels through the reading optical system A and is focused on the imaging element CCD. The imaging element CCD converts the reflected light from the document Gi focused on an imaging surface thereof into red (R), green (G), and blue (B) electric signals.

The image processor IPS converts the RGB electric signals input from the imaging element CCD into black (K), yellow (Y), magenta (M), and cyan (C) image information and temporarily stores the image information. The image processor IPS outputs the temporarily-stored image information as image information for latent-image formation to the write circuit DL at a preset timing.

If the document image is a monochromatic image, only the K image information is input to the write circuit DL.

The write circuit DL has Y, M, C, and K drive circuits (not shown). The write circuit DL outputs signals according to the input image information at a preset timing to the LED heads LHy to LHk arranged for the respective colors.

The surfaces of the photoconductor drums PRy to PRk are electrostatically charged by the charging rollers CRy to CRk. In the write regions Q1*y* to Q1*k*, the LED heads LHy to LHk form electrostatic latent images on the surfaces of the photoconductor drums PRy to PRk. In the developing regions Q2*y* to Q2*y*, the developing devices Gy to Gk develop the electrostatic latent images on the surfaces of the photoconductor drums PRy to PRk into toner images as an example of visible images. When the developers are consumed in the developing devices Gy to Gk, the developing devices Gy to Gk are supplied with new developers from the respective cartridges Ky to Kk in accordance with the consumed amounts.

The toner images on the surfaces of the photoconductor drums PRy to PRk are transported to the first-transfer regions Q3*y*, Q3*m*, Q3*c*, and Q3*k*. The first-transfer rollers T1*y* to T1*k* receive first-transfer voltage with a polarity opposite from the charge polarity of the toners from the power supply circuit E at a preset timing. Therefore, in the first-transfer regions Q3*y* to Q3*k*, the toner images on the photoconductor drums PRy to PRk are sequentially superposed and transferred onto the intermediate transfer belt B in accordance with the first-transfer voltage. In the case of a K monochromatic image, the K toner image alone is transferred onto the intermediate transfer belt B from the K photoconductor drum PRk.

Residues and extraneous matter on the surfaces of the photoconductor drums PRy to PRk after the first-transfer process are cleaned off by the drum cleaners CLy, CLm, CLc, and CLk. The cleaned surfaces of the photoconductor drums PRy to PRk are electrostatically charged again by the charging rollers CRy to CRk.

A recording sheet S from one of the feed trays TR1 to TR3 is picked up by the corresponding pickup roller Rp at a preset feed timing. If multiple recording sheets S in a stacked state are picked up by the pickup roller Rp, the separation roller Rs separates the recording sheets S in a one-by-one fashion. The recording sheet S that has passed the separation roller Rs is transported to the registration roller Rr by the multiple transport rollers Ra.

The registration roller Rr delivers the recording sheet S in accordance with the timing at which the toner images on the surface of the intermediate transfer belt B move to the second-transfer region Q4.

When the recording sheet S delivered from the registration roller Rr passes through the second-transfer region Q4, the toner images on the surface of the intermediate transfer belt B are transferred onto the recording sheet S in accordance with second-transfer voltage applied to the second-transfer roller T2*b*.

After the intermediate transfer belt B passes through the second-transfer region Q4, the belt cleaner CLb cleans the surface of the intermediate transfer belt B by removing residual toner therefrom.

The recording sheet S that has passed through the second-transfer region Q4 subsequently passes through the fixing region Q5 where the toner images are fixed onto the recording sheet S by being heated and pressed by the fixing device F.

The recording sheet S having the toner images fixed thereon is output to the output tray TRh by the output roller Rh.

Fixing Device F According to First Exemplary Embodiment

Figure 3:
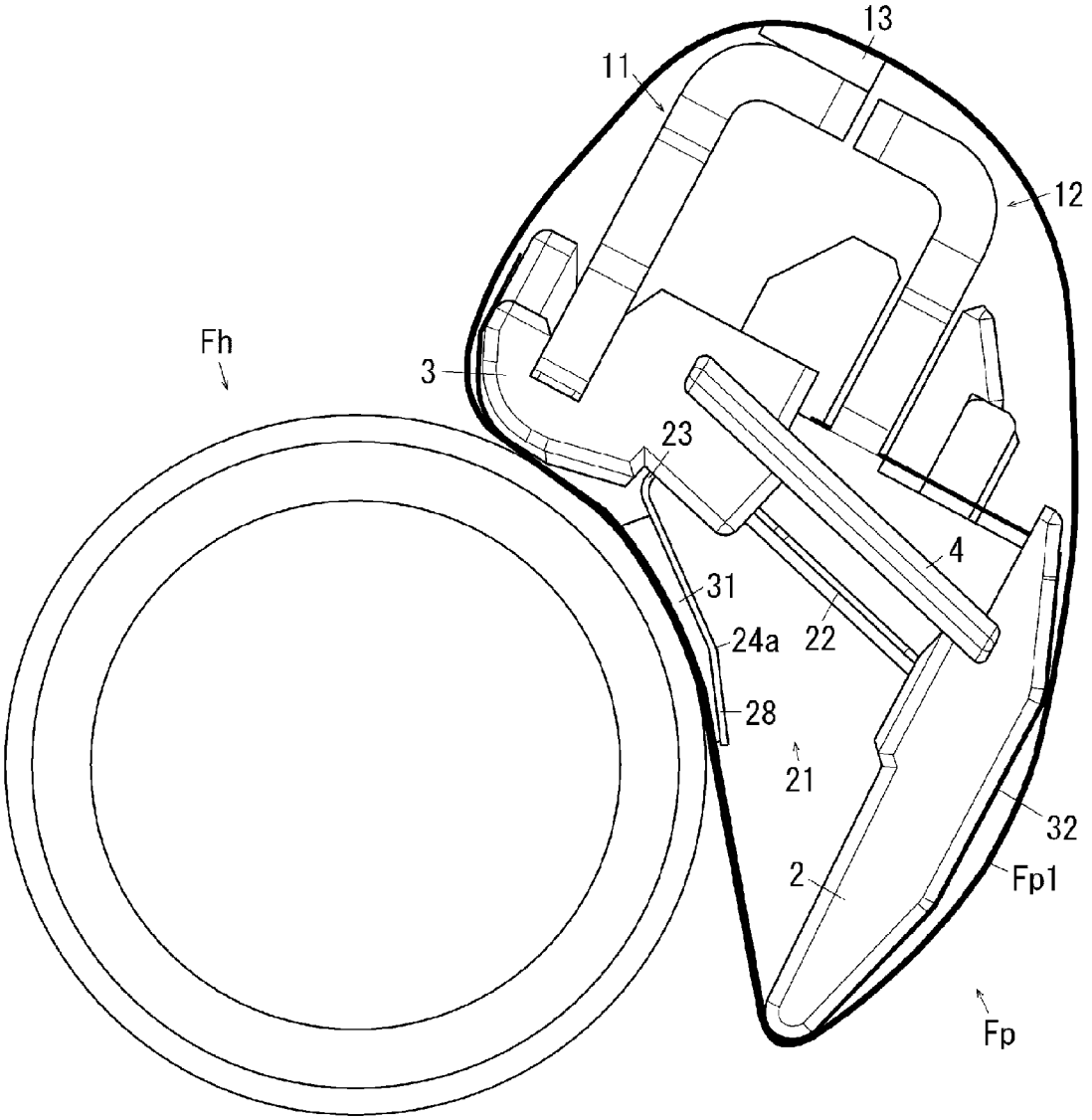
FIG. 3 is an overall view illustrating a fixing device according to the first exemplary embodiment.

FIG. 3 is an overall view illustrating the fixing device F according to the first exemplary embodiment.

Figure 4:
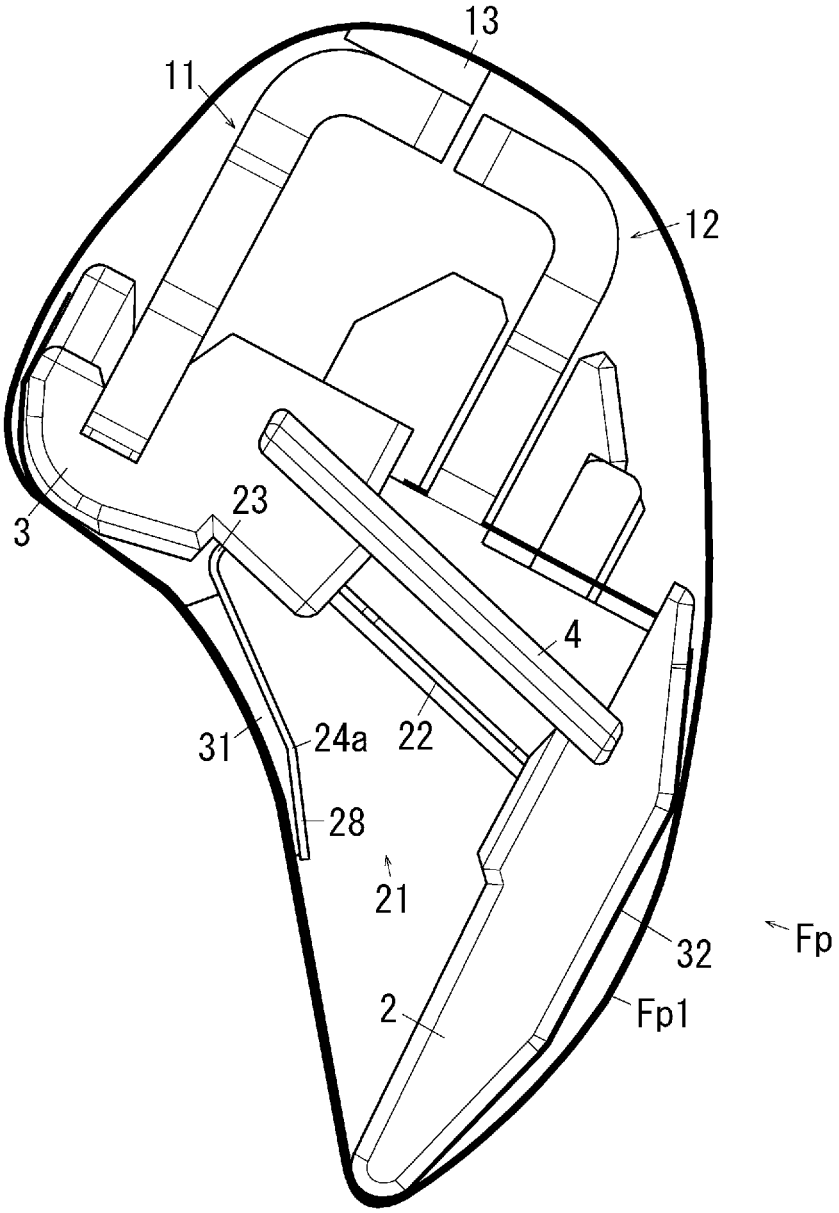
FIG. 4 illustrates a pressure member of the fixing device according to the first exemplary embodiment.

FIG. 4 illustrates the pressure member Fp of the fixing device F according to the first exemplary embodiment.

Figure 5:
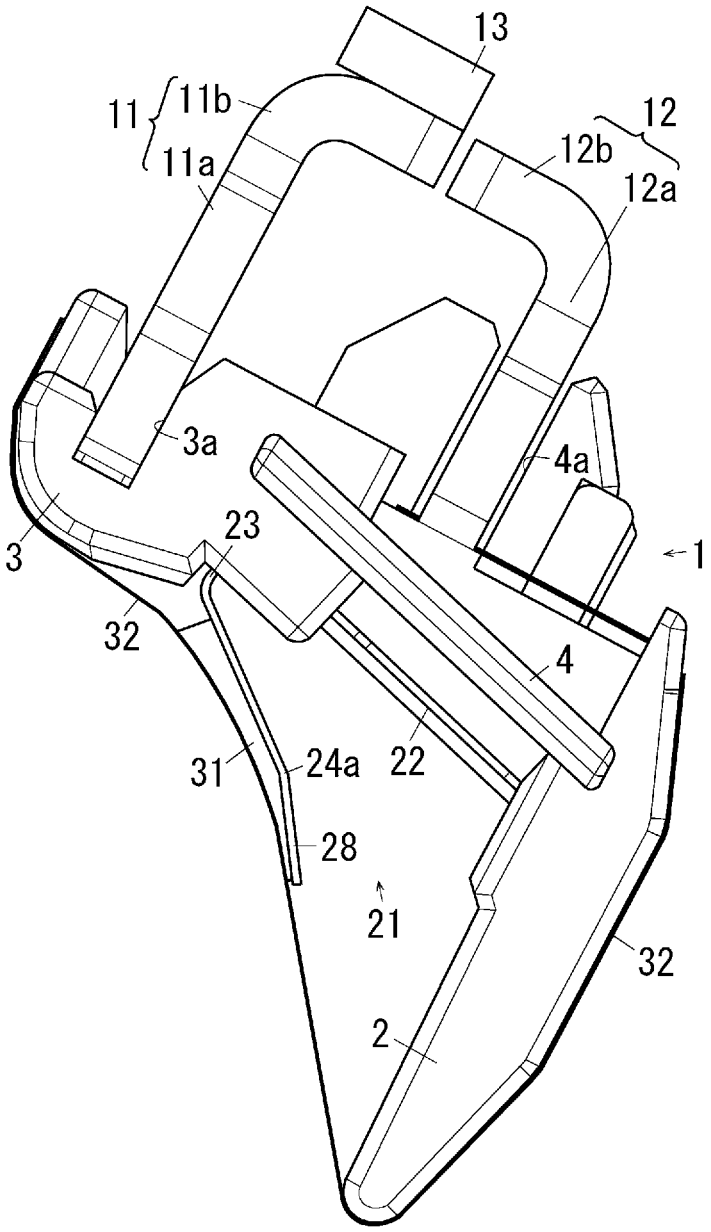
FIG. 5 illustrates a state where a pressure belt is removed from the pressure member shown in FIG. 4.

FIG. 5 illustrates a state where a pressure belt is removed from the pressure member Fp shown in FIG. 4.

Figure 6:
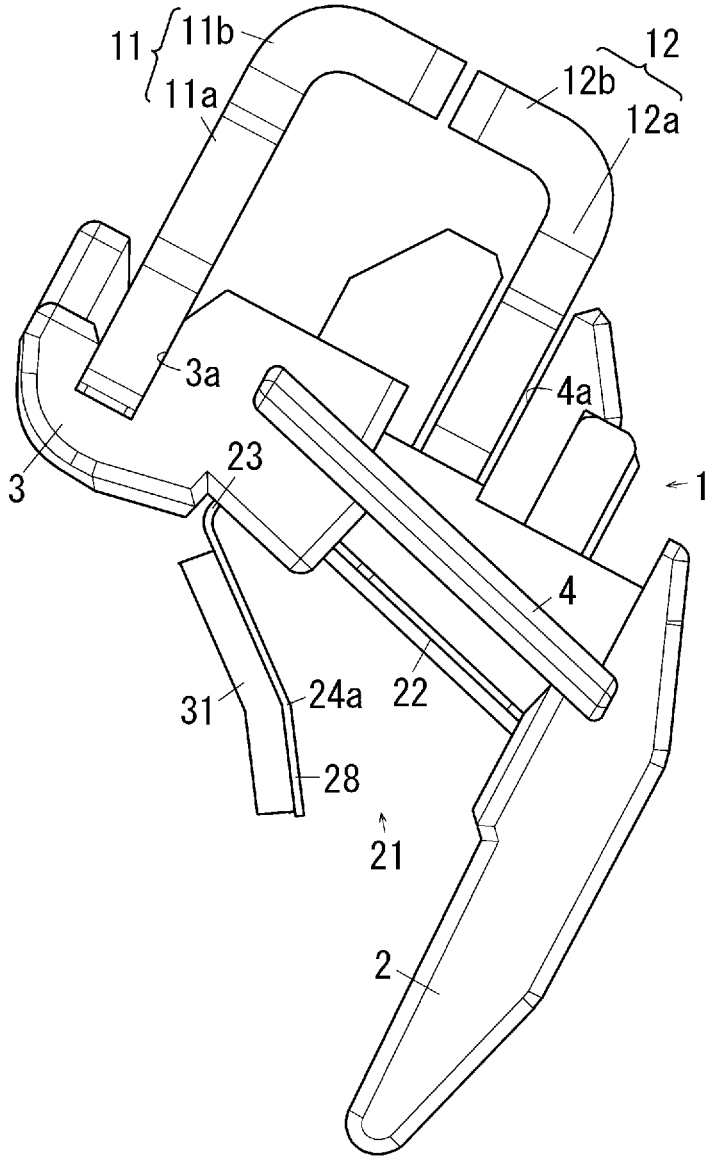
FIG. 6 illustrates a state where oil-impregnated felt and a sheet are removed from the state shown in FIG. 5.

FIG. 6 illustrates a state where oil-impregnated felt and a sheet are removed from the state shown in FIG. 5.

Figure 7B:
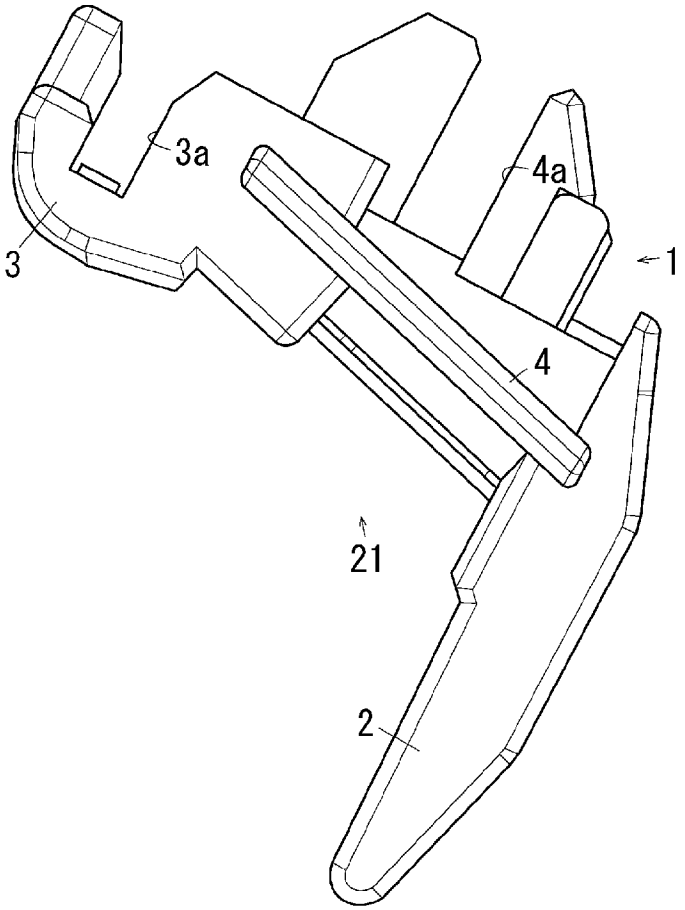
FIGS. 7A and 7B illustrate a support component constituting the pressure member according to the first exemplary embodiment, FIG. 7A being a perspective view thereof, FIG. 7B being a side view thereof.
Figure 7A:
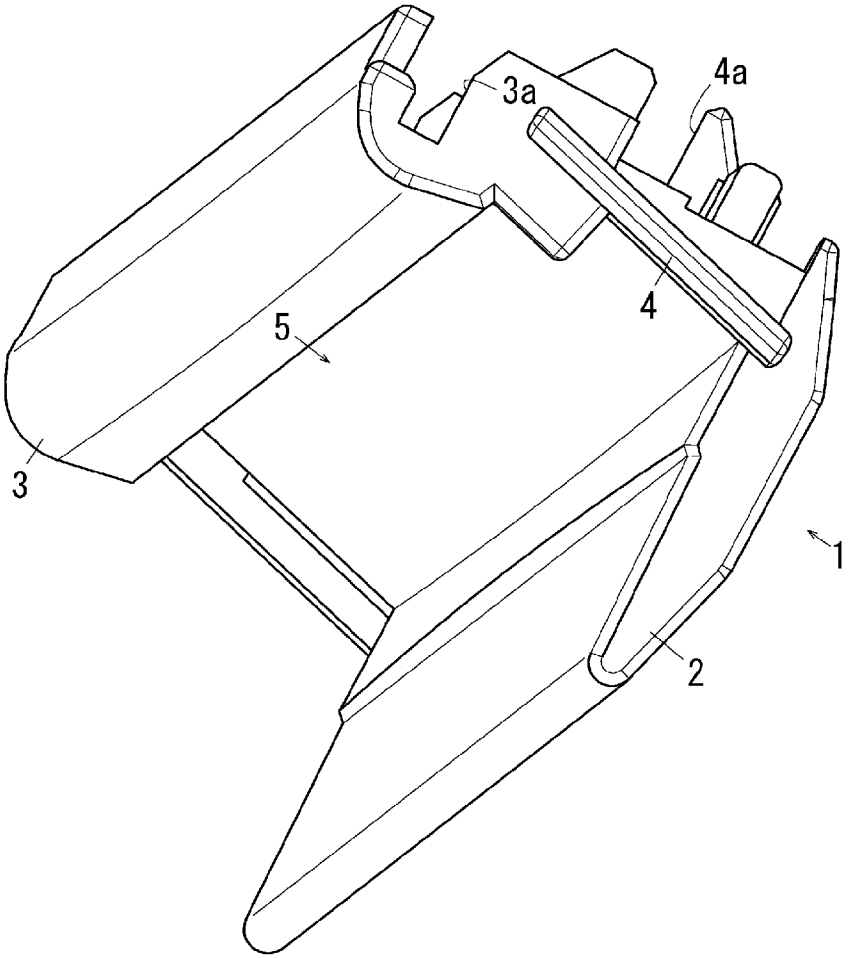

FIGS. 7A and 7B illustrate a support component constituting the pressure member Fp according to the first exemplary embodiment. Specifically, FIG. 7A is a perspective view, and FIG. 7B is a side view.

Figure 8A:
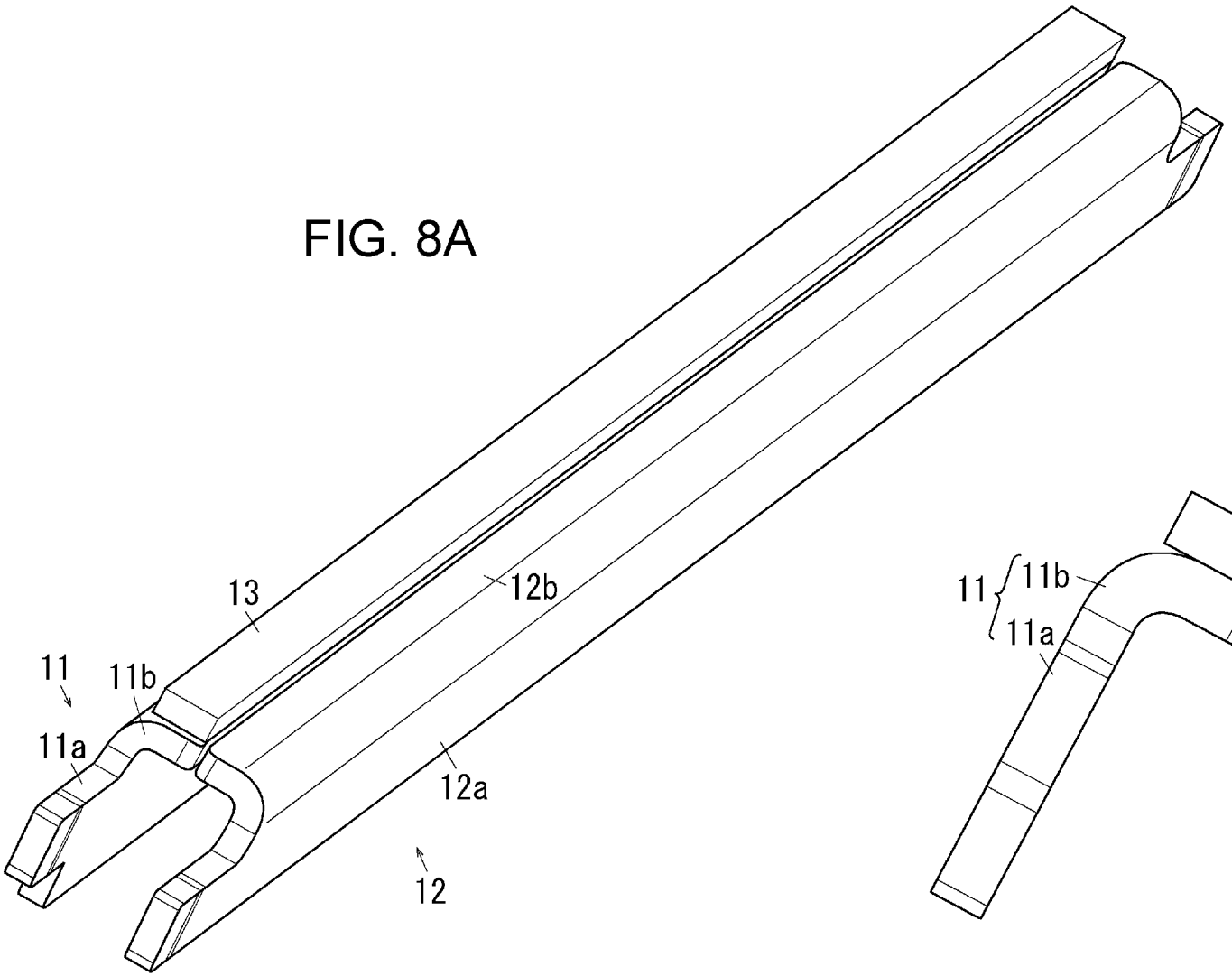
FIGS. 8A and 8B illustrate frame bodies constituting the pressure member according to the first exemplary embodiment, FIG. 8A being a perspective view thereof, FIG. 8B being a side view thereof.
Figure 8B:
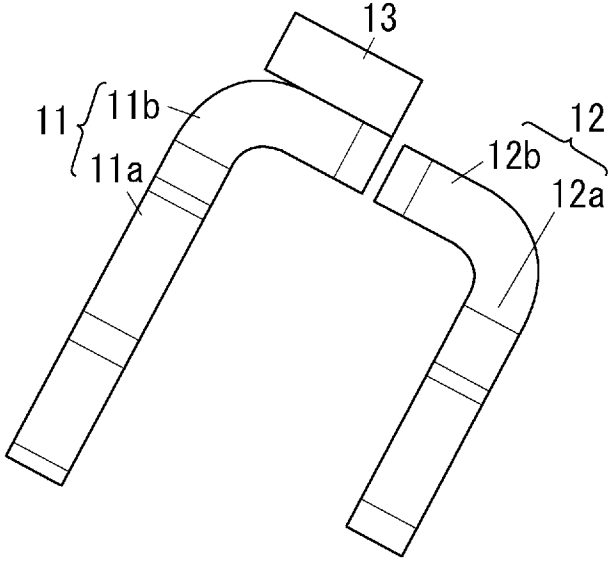

FIGS. 8A and 8B illustrate frame bodies constituting the pressure member Fp according to the first exemplary embodiment. Specifically, FIG. 8A is a perspective view, and FIG. 8B is a side view.

Figure 9A:
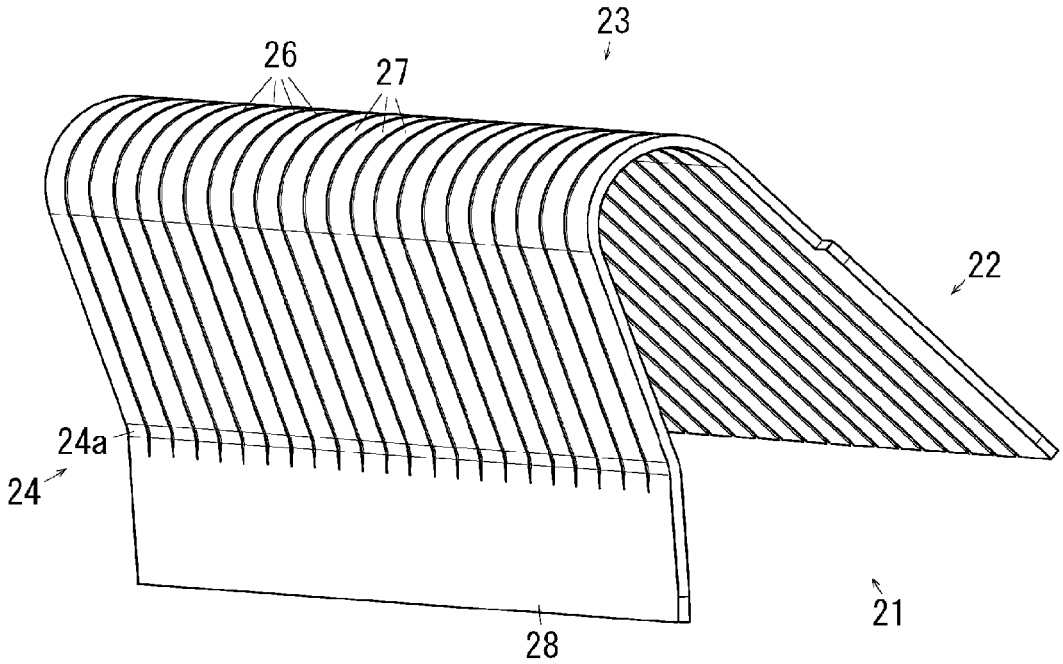
FIGS. 9A and 9B illustrate a pressing component constituting the pressure member according to the first exemplary embodiment, FIG. 9A being a perspective view of the pressing component, FIG. 9B illustrating a state where a contact member is supported by a free end portion of the pressing component.
Figure 9B:
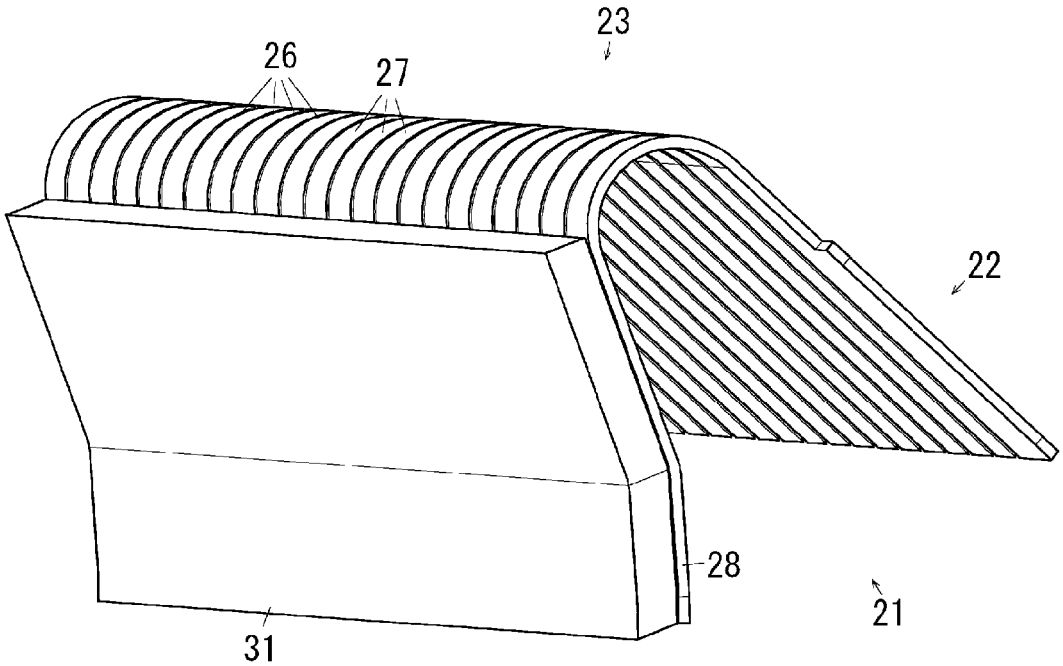

FIGS. 9A and 9B illustrate a pressing component constituting the pressure member according to the first exemplary embodiment. Specifically, FIG. 9A is a perspective view of the pressing component, and FIG. 9B illustrates a state where a contact member is supported by a free end portion of the pressing component.

In FIGS. 4 and 5, the heating roller Fh and a pressure belt Fp1, respectively, are not shown.

Referring to FIGS. 3 to 7B, the pressure member Fp of the fixing device F has a base component 1 as an example of a support component extending in the front-rear direction. In FIGS. 7A and 7B, the base component 1 has an upstream guide section 2 at the lower right portion thereof and a downstream guide section 3 at the upper left portion thereof. The upstream guide section 2 protrudes toward the lower left side, which is the upstream side in the transport direction of the recording sheet S. The upper left end of the downstream guide section 3 has a convex shape, that is, a so-called arc shape, so as to be capable of smoothly guiding the recording sheet S. The upper right portion of the downstream guide section 3 is provided with a first recess 3*a* as an example of a frame-body supporter. The upstream guide section 2 and the downstream guide section 3 are connected to each other by a connection section 4. The upper right portion of the connection section 4 is provided with a second recess 4*a* as an example of a frame-body supporter. An area surrounded by the upstream guide section 2, the downstream guide section 3, and the connection section 4 is provided with a spring accommodation section 5 as an example of a pressing-component accommodation section.

In the base component 1 according to the first exemplary embodiment, the upstream guide section 2, the downstream guide section 3, and the connection section 4 are formed as a single unit by using resin.

Referring to FIGS. 3 to 6 and FIGS. 8A and 8B, a first plate 11 and a second plate 12 as an example of frame bodies are supported at the upper portion of the base component 1. The first plate 11 has a first section 11*a* supported by the first recess 3*a* and a first bent section 11*b* bent toward the lower right side from the outer edge of the first section 11*a*. The first section 11*a* is disposed for reinforcement at the downstream side of the fixing region Q5 in accordance with a position where the force acting on the base component 1 locally increases. The position where the force acting on the base component 1 locally increases is measured and set in advance based on, for example, tests or simulation.

The outer surface of the first bent section 11*b* supports oil-impregnated felt 13 as an example of a lubricant supplying member. The oil-impregnated felt 13 is supported in contact with the inner surface of the pressure belt Fp1 as an example of a belt-shaped component. The oil-impregnated felt 13 is impregnated with silicone oil as an example of a lubricant. The silicone oil may be supplied by being applied to the inner surface of the pressure belt Fp1 from the oil-impregnated felt 13.

The second plate 12 has a second section 12*a* supported by the second recess 4*a* and a second bent section 12*b* bent toward the upper left side from the outer edge of the second section 12*a*. The second section 12*a* is disposed at the upstream side of the fixing region Q5 in accordance with a position where the force acting on the base component 1 locally increases.

Each of the first plate 11 and the second plate 12 has a plate shape extending in the front-rear direction, and the front and rear ends thereof are supported by a frame plate (not shown) of the fixing device F.

Referring to FIGS. 3 to 6 and FIGS. 9A and 9B, the spring accommodation section 5 supports a plate spring 21 as an example of a pressing component. With regard to the plate spring 21 according to the first exemplary embodiment, the front and rear widthwise ends thereof are fixed to the base component 1. The plate spring 21 is electrically connected to ground. The plate spring 21 has a base end portion 22 that extends toward the downstream guide section 3 from the upstream guide section 2 in the transport direction of the recording sheet S. With regard to the plate spring 21 according to the first exemplary embodiment, an end of the base end portion 22 closer toward the upstream guide section 2 is in contact with the inner surface of the upstream guide section 2 so as to be fixed thereto in a positioned state.

An end of the base end portion 22 closer toward the downstream guide section 3 is provided with a folded portion 23 extending continuously from the base end portion 22 and folded in a substantially U-shape toward the fixing region Q5. An end of the folded portion 23 closer toward the fixing region Q5 is provided with a pressing portion 24 extending continuously from the folded portion 23 toward the upstream guide section 2.

Furthermore, in the plate spring 21 according to the first exemplary embodiment, multiple slits 26 as an example of gaps extend from the end of the base end portion 22, that is, the fixed base end, to an intermediate point of the pressing portion 24 via the folded portion 23. The slits 26 are arranged at predetermined pitch in the front-rear direction. Thus, the areas interposed between the slits 26 constitute reed-shaped biasing portions 27. The slits 26 do not extend to the end of the pressing portion 24, that is, the free end, and the free ends of the biasing portions 27 are connected together by a free end portion 28 extending in the front-rear direction, that is, the width direction of the recording sheet S.

Referring to FIGS. 9A and 9B, the free end of the pressing portion 24 according to the first exemplary embodiment is provided with a bent portion 24*a* that is bent toward the heating roller Fh. As shown in FIG. 9A, in the first exemplary embodiment, the slits 26 extend toward the free end beyond the bent portion 24*a*. Thus, the plate spring 21 may be fabricated by forming the slits 26 in a single metallic plate and then bending the metallic plate along the folded portion 23 and the bent portion 24*a*.

The surface of the pressing portion 24 at the fixing region Q5 side supports felt 31 as an example of a contact member. If the felt 31 is not provided, there is a risk of the free end portion 28 of the plate spring 21 locally coming into contact with the heating roller Fh. In the first exemplary embodiment, the pressing portion 24 is provided with the felt 31 so that contact pressure may be ensured over a large surface area, as compared with a case where the felt 31 is not provided.

Referring to FIGS. 3 to 5, the fixing region Q5 side of the base component 1 and the plate spring 21 supports a sheet 32. In FIG. 5, the sheet 32 extends around the lower left end of the upstream guide section 2 from the upper right portion thereof, comes into contact with the felt 31 on the surface of the plate spring 21, and extends around the upper left end of the downstream guide section 3 to the upper right portion thereof. Thus, as shown in FIGS. 3 and 4, the sheet 32 covers the outer side so as to prevent the base component 1, the plate spring 21, and the felt 31 from directly coming into contact with the pressure belt Fp1. In other words, if the sheet 32 is not provided, there would be areas that may possibly come into direct contact with the rotating pressure belt Fp1. The surface of the sheet 32 according to the first exemplary embodiment is composed of fluorocarbon resin as an example of a low friction material.

Therefore, the pressure belt Fp1 according to the first exemplary embodiment is supported in a stretched state at the positions of the lower left end and the lower right portion of the upstream guide section 2, the plate spring 21, the upper left portion of the downstream guide section 3, and the oil-impregnated felt 13. As described above, the pressure belt Fp1 is not directly in contact with, for example, the upstream guide section 2 or the plate spring 21, but is supported indirectly via the sheet 32.

Operation of First Exemplary Embodiment

When image forming operation, that is, a job, commences in the copier U according to the first exemplary embodiment having the above-described configuration, electrostatic latent images on the surfaces of the photoconductor drums PRy to PRk are developed, and the images are transferred onto a recording sheet S passing through the second-transfer region Q4 via, for example, the belt module BM. The unfixed images on the surface of the recording sheet S are fixed thereon by being heated and pressed by the fixing device F. In this case, the pressure belt Fp1 is pressed against the heating roller Fh by the plate spring 21 of the pressure member Fp so that the fixing region Q5 according to the first exemplary embodiment is formed.

Thus, in the copier U according to the first exemplary embodiment, the plate spring 21 has multiple biasing portions 27 formed in the width direction of the recording sheet S. Therefore, even in the case of a single recording sheet S having various thicknesses in the width direction, such as an envelope having a bonding area or a flap, the biasing portions 27 elastically deform in correspondence with the thicknesses when the recording sheet S passes through the fixing region Q5. Supposing that a single plate spring not having slits arranged in the width direction is used, when the plate spring elastically deforms in correspondence with a thick area of the recording sheet S, the fixation pressure may be locally insufficient for a thin area of the recording sheet S, possibly resulting in a fixation defect. In contrast, the occurrence of such a fixation defect may be reduced in the first exemplary embodiment.

Figure 10:
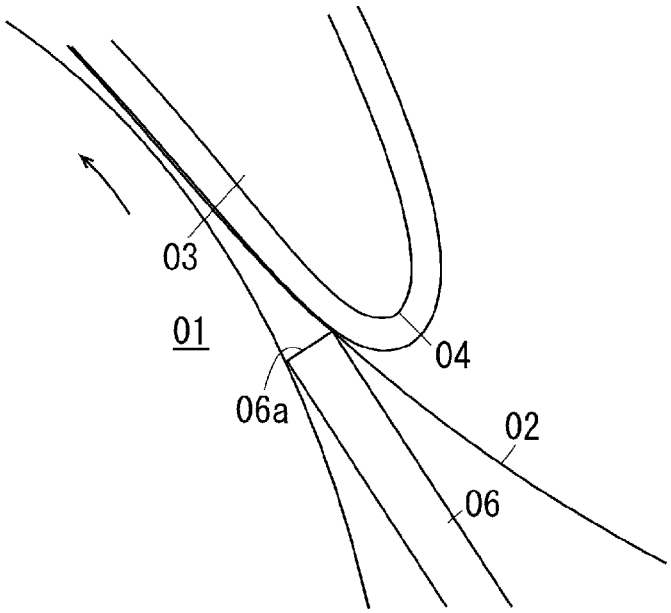
FIG. 10 RELATED ART
FIG. 10 illustrates a technology in the related art.

FIG. 10 illustrates a technology in the related art.

Referring to FIG. 10, if the free end portion is disposed at the downstream side, as in the configuration of Japanese Unexamined Patent Application Publication No. 2012-208308, a folded portion 04 would be disposed upstream of a fixing region 03 where a heating roller 01 and a pressure belt 02 come into contact with each other. Thus, in the configuration of Japanese Unexamined Patent Application Publication No. 2012-208308, when a leading edge 06*a* of a recording sheet 06 having various thicknesses, such as an envelope, enters the fixing region 03, the leading edge 06*a* of the recording sheet 06 passes the folded portion 04 disposed at the upstream side. Therefore, due to slits formed in the folded portion 04, the biasing portions elastically deform in correspondence with the differences in thicknesses of the recording sheet 06 in the width direction. Thus, in the configuration of Japanese Unexamined Patent Application Publication No. 2012-208308, when the leading edge 06*a* of the recording sheet 06 enters the fixing region 03, specifically, in a state prior to the recording sheet 06 being nipped by the heating roller 01 and the pressure belt 02 with a preset fixation pressure, the biasing portions deform in correspondence with the thicknesses, so that the elastic force received by the recording sheet 06 varies in the width direction. When the force received by the recording sheet 06 varies in the width direction, the leading edge 06*a* of the recording sheet 06 may sometimes cockle in the width direction. If the cockled leading edge 06*a* of the recording sheet 06 is transported downstream and is nipped by the heating roller 01 and the pressure belt 02, the recording sheet 06 may possibly become wrinkled. Therefore, in the configuration of Japanese Unexamined Patent Application Publication No. 2012-208308, image formation defects may possibly occur, such as a fixation defect in which an image is not fixed at a wrinkle or near a wrinkled area.

In contrast, the fixing device F according to the first exemplary embodiment differs from the configuration of Japanese Unexamined Patent Application Publication No. 2012-208308 in that the free end portion 28 not having the slits 26 formed therein is disposed upstream of the fixing region Q5. Thus, when the recording sheet S enters the fixing region Q5, the free end portion 28 extending continuously in the width direction suppresses independent movements of the biasing portions 27, thereby reducing cockling of the recording sheet S in the width direction. Consequently, the occurrence of wrinkles in the recording sheet S may be reduced, as compared with the configuration of Japanese Unexamined Patent Application Publication No. 2012-208308. Therefore, the occurrence of image formation defects may be reduced, as compared with the configuration of Japanese Unexamined Patent Application Publication No. 2012-208308.

Furthermore, in the first exemplary embodiment, the plate spring 21 is provided with the slits 26 in the fixing region Q5 so that when the recording sheet S passes through the fixing region Q5, each biasing portion 27 elastically deforms in correspondence with the thickness of the recording sheet S, thereby reducing the occurrence of a fixation defect.

Figure 11:
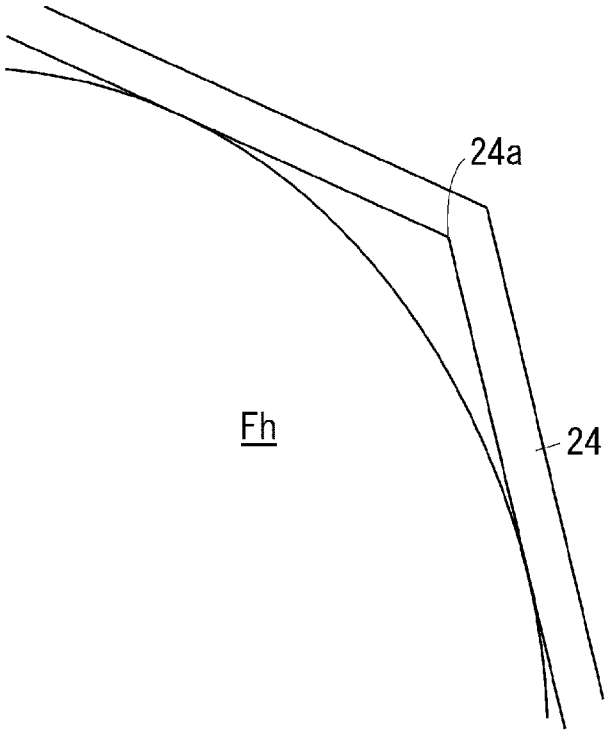
FIG. 11 is an enlarged view of an area surrounding a bent portion according to the first exemplary embodiment.

FIG. 11 is an enlarged view of an area surrounding the bent portion 24*a* according to the first exemplary embodiment.

In the first exemplary embodiment, the pressing portion 24 is provided with the bent portion 24*a*. Therefore, as shown in FIG. 11, the pressure belt Fp1 is pressed by the plate spring 21 at the front and rear sides of the bent portion 24*a* in the transport direction of the recording sheet S. Thus, the range in which the pressure belt Fp1 is pressed against the heating roller Fh, that is, the fixing region Q5, is increased, as compared with a case where the bent portion 24*a* is not provided. The larger fixing region Q5 may allow a sufficient amount of heat to be applied to recording sheets S successively passing therethrough, as compared with a case where the fixing region Q5 is small, thereby allowing for a stable fixing process.

Furthermore, the slits 26 extend toward the free end beyond the bent portion 24*a* in the first exemplary embodiment. Supposing that the slits 26 only extend to the folded portion 23 side of the bent portion 24*a*, the biasing portions 27 would not be provided upstream of the bent portion 24*a* in the large fixing region Q5, possibly causing a fixation defect to occur due to a local shortage of fixation pressure. In contrast, in the first exemplary embodiment, the slits 26 extend toward the free end beyond the bent portion 24*a* so that the occurrence of a fixation defect may be reduced.

Modifications

Although the exemplary embodiment of the present invention has been described in detail above, the present invention is not to be limited to the above exemplary embodiment and permits various modifications within the technical scope of the invention defined in the claims. Modifications H01 to H05 will be described below.

In a first modification H01, the image forming apparatus according to the above exemplary embodiment is not limited to the copier U, and may be, for example, a facsimile apparatus or a multifunction apparatus having multiple functions of such apparatuses. Furthermore, the above exemplary embodiment is not limited to a multicolor image forming apparatus and may be applied to a so-called monochrome image forming apparatus.

In the above exemplary embodiment, the pressure belt Fp1 is an endless belt. Alternatively, for example, in a second modification H02, a belt wound around a feeding roller may be fed therefrom and be wound around a winding roller after passing through the fixing region Q5.

In the above exemplary embodiment, the number, the pitch, and the width of the slits 26 are not limited to those described in the exemplary embodiment. Alternatively, for example, in a third modification H03, the slits 26 may be configured similarly to those in Japanese Unexamined Patent Application Publication No. 2012-208308. Moreover, although the slits 26 desirably extend toward the free end beyond the bent portion 24*a*, the slits 26 may alternatively extend toward the base end relative to the bent portion 24*a*.

In the above exemplary embodiment, it is desirable that the bent portion 24*a* be provided. Alternatively, in a fourth modification H04, a configuration in which the bent portion 24*a* is not provided is also permissible.

In the above exemplary embodiment, the plate spring 21 has a substantially U-shape with a single folded portion 23. Alternatively, for example, in a fifth modification H05, the plate spring 21 may have a freely-chosen shape, such as a lateral L-shape or S-shape as viewed from the front.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first fixing member that is supported in a rotatable manner; and a second fixing member that is pressed against the first fixing member, the second fixing member including:

a belt-shaped component extending in a width direction of a medium that passes through a contact region where the belt-shaped component comes into contact with the first fixing member;

a support component that is disposed opposite the first fixing member with the belt-shaped component interposed therebetween; and a pressing component that has a base end portion supported by the support component and a free end portion extending toward the contact region and that presses the belt-shaped component against the first fixing member, wherein the pressing component has a plurality of biasing portions that are arranged apart in the width direction and that are elastically deformable in correspondence with a thickness of the medium, wherein the biasing portions are connected in the width direction of the medium by the free end portion, and wherein the free end portion is disposed at an upstream side of the biasing portions in a transport direction of the medium.

2. The fixing device according to claim 1, wherein a gap between the biasing portions extends to a position corresponding to the contact region.

3. The fixing device according to claim 1, wherein the pressing component is provided with a bent portion such that the belt-shaped component comes into contact with the first fixing member at a plurality of positions in a rotational direction of the first fixing member.

4. The fixing device according to claim 3, wherein a gap between the biasing portions extends to an area of the bent portion.

5. An image forming apparatus comprising:

a transfer device that transfers an image onto a medium from an image carrier that carries the image on a surface of the image carrier; and the fixing device according to claim 1 that heats and presses the image transferred on the medium so as to fix the image onto the medium.

6. A pressure member that is pressed against a first fixing member supported in a rotatable manner, the pressure member comprising:

a belt-shaped component extending in a width direction of a medium that passes through a contact region where the belt-shaped component comes into contact with the first fixing member;

a support component that is disposed opposite the first fixing member with the belt-shaped component interposed therebetween; and a pressing component that has a base end portion supported by the support component and a free end portion extending toward the contact region and that presses the belt-shaped component against the first fixing member by causing the free end portion to press the belt-shaped component toward the first fixing member, wherein the pressing component has a plurality of biasing portions that are arranged apart in the width direction and that are elastically deformable in correspondence with a thickness of the medium, wherein the biasing portions are connected in the width direction of the medium by the free end portion, and wherein the free end portion is disposed at an upstream side of the biasing portions in a transport direction of the medium.

* * * * *